US007028842B1

(12) United States Patent
Manka et al.

(10) Patent No.: US 7,028,842 B1
(45) Date of Patent: Apr. 18, 2006

(54) CASE INDICATIVE OF SPECIFIC GREENS OF A SPECIFIC GOLF COURSE FOR DISPLAYING GOLF BALLS ON TEES

(76) Inventors: Michael F. Manka, 2942 S. Loomis St., Chicago, IL (US) 60608-5614; Joseph Maggio, 9247 S. 89th Ct., Hickory Hills, IL (US) 60457

( * ) Notice: Subject to any disclaimer, the term of this patent is extended or adjusted under 35 U.S.C. 154(b) by 213 days.

(21) Appl. No.: 10/751,724

(22) Filed: Jan. 5, 2004

(51) Int. Cl.
*B65D 71/00* (2006.01)

(52) U.S. Cl. ..... 206/579; 206/315.1

(58) Field of Classification Search ..... 206/38, 206/315.9, 575, 579, 769, 771, 781; 224/918
See application file for complete search history.

(56) References Cited

U.S. PATENT DOCUMENTS 3,110,376 A * 11/1963 Naab et al. ..... 190/109
5,058,733 A 10/1991 Lowe
5,190,127 A * 3/1993 Cummings ..... 190/102
5,377,829 A 1/1995 Bahl
D391,100 S * 2/1998 Hawkersmith ..... D6/472
5,715,947 A 2/1998 Gonzales
5,799,791 A * 9/1998 Harley ..... 206/478
5,868,249 A 2/1999 Ehnert
5,971,826 A 10/1999 Delzompo et al.
6,082,545 A * 7/2000 Ford et al. ..... 206/579
6,283,297 B1 * 9/2001 Mosley ..... 206/575
D464,216 S 10/2002 Rone
6,735,831 B1 * 5/2004 Greiwe et al. ..... 27/1

* cited by examiner

*Primary Examiner*—David T. Fidei
(74) *Attorney, Agent, or Firm*—Richard L. Miller

(57) ABSTRACT

A case indicative of specific greens of a specific golf course for displaying golf balls on tees. The case includes a display case and golf course-related elements sitting in the display case. The golf course-related elements include at least one insert. Each insert has a through bore replicating the hole in a specific green of a specific golf course for holding a split tee teeing a golf ball, a top surface having indicia thereon pictorially replicating a specific green of a specific golf course, and a bottom surface having a portion of hook and loop fasteners thereon. The portion of hook and loop fasteners on each insert selectively mates with a sheet of a mating portion of hook and loop fasteners in the display case so as to allow each insert to be interchanged to replicate a specific green of a specific golf course.

16 Claims, 1 Drawing Sheet

CASE INDICATIVE OF SPECIFIC GREENS OF A SPECIFIC GOLF COURSE FOR DISPLAYING GOLF BALLS ON TEES

BACKGROUND OF THE INVENTION

1. Field of the Invention

The present invention relates to a display case. More particularly, the present invention relates to a case indicative of specific greens of a specific golf course for displaying golf balls on tees.

2. Description of the Prior Art

Numerous innovations for display cases have been provided in the prior art that will be described. Even though these innovations may be suitable for the specific individual purposes to which they address, however, they differ from the present invention.

A FIRST EXAMPLE, U.S. Pat. No. 5,058,733 to Lowe teaches a rectangular housing for a buckle less belt used in the marshall arts to denote expertise in that marshall art. The housing is designed to contain a belt in a coiled state. The belt is coiled around a centrally positioned cylindrical post. A portion of the belt may be held in position either on the post by means of a medallion denoting the specific marshall art sport or loosely coiled to fit firmly against the sides of the housing. The medallion is circular with a diameter larger than the post and is centrally attached to and positioned on the distal end of the post. The post is fixedly attached to the back wall of the housing.

A SECOND EXAMPLE, U.S. Pat. No. 5,377,829 to Bahl teaches a football display case comprising a base in a rectangular configuration having an upper surface and a lower surface, the base being sanded, stained and finished with polyurethane; a piece of plywood in a rectangular configuration having an upper and lower surface and glued at its lower surface to the upper surface of the base; a piece of artificial turf in a rectangular configuration having an upper surface and a lower surface and glued at its lower surface to the upper surface of the plywood, the piece of turf having a length and width essentially the same as that of the plywood; four apertures formed in the base, plywood and turf in a rectangular configuration, the four dowels located in the apertures to an extent upwardly for holding a football on the dowels; and an oak frame resting on the base, the frame having a rectangular upper section with an external periphery greater than the plywood and turf but less than the base, the frame also including four vertical posts coupled at their upper ends to the rectangular upper section at its corners and resting at its lower ends upon the turf and base.

A THIRD EXAMPLE, U.S. Pat. No. 5,715,947 to Gonzales teaches a display case for storing and displaying golf balls. The display case is in the shape of a pyramid. When displayed with golf balls, the inside structure, which is the upper support surface that is connected to the support base and mounts the golf balls, also has the appearance of a pyramid thereon. The upper support surface that is attached to the support base of the storage and display case, includes a plurality of members of different lengths separately arranged and mounted in a vertical fashion representing a pyramid, each member supports each golf ball. The upper support surface is enclosed by a transparent cover that is also the shape of a pyramid and is removable from the top, to place or retrieve the golf balls therein. The support base is the bottom that supports the storage and display case. The storage and display case, by its simple design and attractive appearance, is considered a sculptured work of art and collectors item by the golf ball collection that it displays.

The golf balls are mounted in a descending order from top to bottom, which may be arranged to one's own personal preference or valued importance. The golf ball storage and display case is easily displayed in the middle of a room, on a office desk, a display table, an end table, or in a trophy cabinet.

A FOURTH EXAMPLE, U.S. Pat. No. 5,868,249 to Ehnert teaches an enclosed transparent display case for sports balls comprising a base section removably attached to rounded top section which incorporates rotatably affixed handle calipers to secure and suspend the sports ball within the display case. The display case provides the ability to suspend the ball within the interior of the display case and allow the ball to be rotatably controlled by a viewer and observe the ball with a clear view and a normal viewing angle without picking up the display or removing the ball.

A FIFTH EXAMPLE, U.S. Pat. No. 5,971,826 to Delzompo et al. teaches a system of display case modules that can be connected to form a display case of variable size and configuration for displaying or storing toys and toy action figures. A single display module has shelves to make variable size compartments and has a clear front panel to allow viewing of the toys, which are vertically stacked inside the display module. The shelves can be varied in position so that various sizes of toys can be displayed. In addition, the shelves are tilted slightly backward so that toys lean against a back wall of the display module, thereby resting upright. The display module also has connectors on its sides, top and bottom so that the display module can be connected to other display modules to make a larger display case. The connectors on the sides of the display modules create a hinge mechanism to link display modules side by side, such that the modules can be pivoted in various directions with respect to each other. The connectors on the top and bottom of the display modules permit multiple display modules to be stacked on top of one another, or to be connected to an optional locking plate, facilitating storage of multiple display modules as an integral toy chest.

A SIXTH EXAMPLE, U.S. Pat. No. D 464,216 S to Rone teaches the ornamental design for a golf ball display case.

It is apparent that numerous innovations for display cases have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a case indicative of specific greens of a specific golf course for displaying golf balls on tees that avoids the disadvantages of the prior art.

ANOTHER OBJECT of the present invention is to provide a case indicative of specific greens of a specific golf course for displaying golf balls on tees that is simple to use.

BRIEFLY STATED, STILL ANOTHER OBJECT of the present invention is to provide a case indicative of specific greens of a specific golf course for displaying golf balls on tees. The case includes a display case and golf course-related elements sitting in the display case. The golf course-related elements include at least one insert. Each insert has a through bore replicating the hole in a specific green of a specific golf course for holding a split tee teeing a golf ball, a top surface having indicia thereon pictorially replicating a specific green of a specific golf course, and a bottom surface having a portion of hook and loop fasteners thereon. The portion of hook and loop fasteners on each insert selectively mates with a sheet of a mating portion of hook and loop fasteners in the display case so as to allow each insert to be interchanged to replicate a specific green of a specific golf course.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
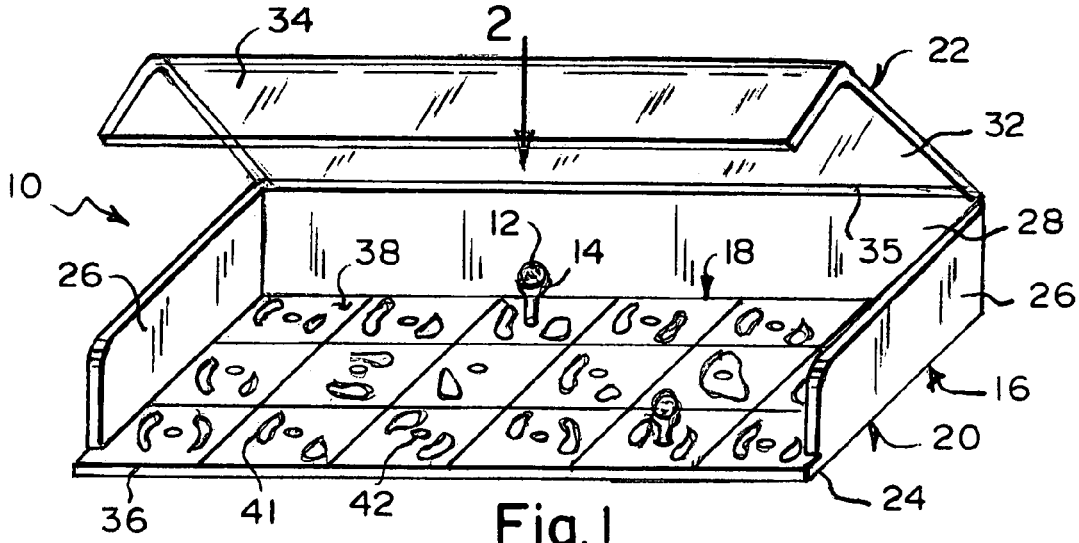
FIG. 1 is a diagrammatic perspective view of the present invention in use, with the top portion shown in phantom partly open.

10 case indicative of specific greens of specific golf course of present invention for displaying golf balls 12 on tees 14
12 golf balls on tees 14
14 tees
16 display case
18 golf course-related elements
20 bottom portion of display case 16
22 top portion of display case 16
24 bottom wall of bottom portion 20 of display case 16
26 pair of side walls of bottom portion 20 of display case 16
28 rear wall of bottom portion 20 of display case 16
32 top wall of top portion 22 of display case 16
34 front wall of top portion 22 of display case 16
35 hinge of display case 16
36 at least one insert of golf course-related elements 18
38 top surface of each insert of at least one insert 36 of golf course-related elements 18
40 bottom surface of each insert of at least one insert 36 of golf course-related elements 18
41 indicia on top surface 38 of each insert of at least one insert
36 of golf course-related elements 18
42 through bore through each insert of at least one insert 36 of golf course-related elements 18
44 portion of hook and loop fasteners on bottom surface 40 of each insert of at least one insert 36 of golf course-related elements 18
46 sheet of mating portion of hook and loop fasteners covering bottom wall 24 of bottom portion 20 of display case 16
48 split shaft of tee 14
50 matching socket in bottom wall 24

DETAILED DESCRIPTION OF THE PREFERRED EMBODIMENT

Referring now to the figures, in which like numerals indicate like parts, and particularly to FIG. 1, the case indicative of specific greens of a specific golf course of the present invention is shown generally at 10 for displaying golf balls 12 on tees 14.

The case 10 indicative of specific greens of a specific golf course 10 comprises a display case 16 and golf course-related elements 18. The golf course-related elements 18 are disposed in the display case 16.

The display case 16 is generally rectangular-parallelepiped-shaped, and has a bottom portion 20 and a top portion 22. The top portion 22 of the display case 16 selectively closes the bottom portion 20 of the display case 16.

The bottom portion 20 of the display case 16 has a bottom wall 24, a pair of side walls 26 and a rear wall 28.

The top portion 22 of the display case 16 has a top wall 32 and a front wall 34. The top wall 32 of the top portion 22 of the display case 16 is preferably transparent so as to allow seeing the golf-course related elements 18 in the display case 16 from their tops when the top portion 22 of the display case 16 is closed.

The front wall 34 of the top portion 22 of the display case 16 is also preferably transparent so as to allow seeing the golf-course related elements 18 in the display case 16 from their sides when the top portion 22 of the display case 16 is closed.

The top wall 32 of the top portion 22 of the display case 16 is hingedly attached, by hinge 35, to the rear wall 28 of the bottom portion 20 of the display case 16. The front wall 34 of the top portion 22 of the display case 16 depends from the top wall 32 of the top portion 22 of the display case 16 and overlies a front opening of the bottom portion 20 of the display case 16 when the top portion 22 of the display case 16 is closed.

The golf course-related elements 18 sit on the bottom wall 24 of the bottom portion 20 of the display case 16.

Figure 2:
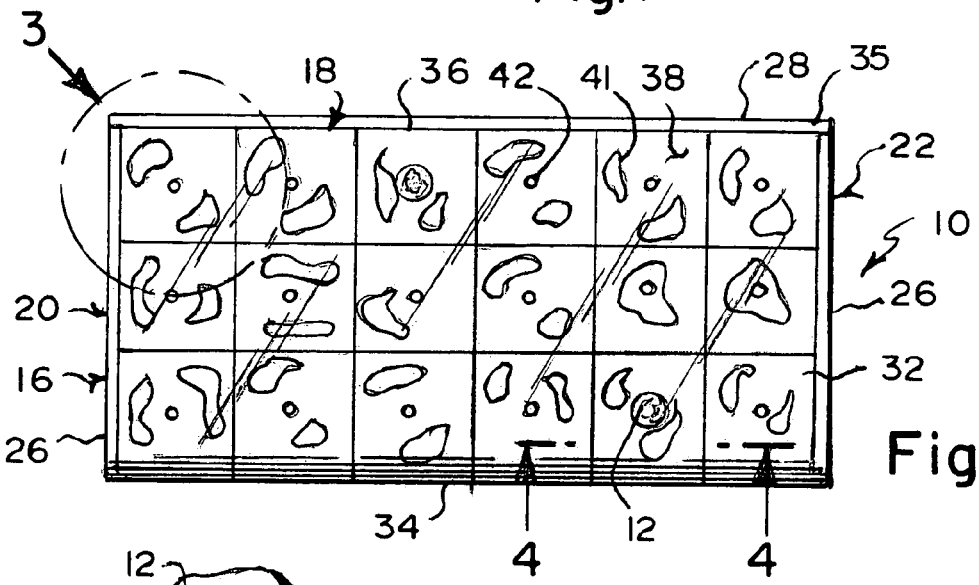
FIG. 2 is a diagrammatic top plan view taken generally in the direction of arrow 2 in FIG. 1, with the top portion closed.
Figure 3:
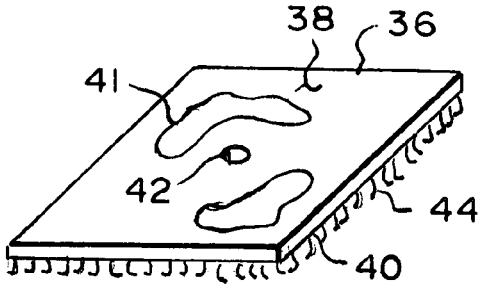
FIG. 3 is an enlarged diagrammatic perspective view of one insert in the area generally enclosed by the dotted curve identified by arrow 3 in FIG. 2.

The specific configuration of the golf course-related elements 18 can best be seen in FIGS. 2–4, and as such, will be discussed with reference thereto.

The golf course-related elements 18 comprise at least one insert 36. Each insert of the at least one insert 36 of the golf course-related elements 18 replicates a specific green of a specific golf course, and is preferably eighteen to replicate the eighteen holes of a standard golf course.

Each insert of the at least one insert 36 of the golf course-related elements 18 is generally flat and square-shaped, and has a top surface 38 and a bottom surface 40.

The top surface 38 of each insert of the at least one insert 36 of the golf course-related elements 18 has indicia 41 thereon. The indicia 41 on the top surface 38 of each insert of the at least one insert 36 of the golf course-related elements 18 pictorially replicates a specific green of a specific golf course.

Each insert of the at least one insert 36 of the golf course-related elements 18 further has a through bore 42. The through bore 42 extends centrally through an associated insert of the at least one insert 36 of the golf course-related elements 18 and replicates the hole in a specific green of a specific golf course.

The bottom surface 40 of each insert of the at least one insert 36 of the golf course-related elements 18 has a portion of hook and loop fasteners 44 thereon. The portion of hook and loop fasteners 44 on the bottom surface 40 of each insert of the at least one insert 36 of the golf course-related elements 18 selectively mates with a sheet of a mating portion of hook and loop fasteners 46 that covers the bottom wall 24 of the bottom portion 20 of the display case 16 (FIG. 4) so as to allow each insert of the at least one insert 36 of the golf course-related elements 18 to be interchanged to replicate a specific green of a specific golf course.

Figure 4:
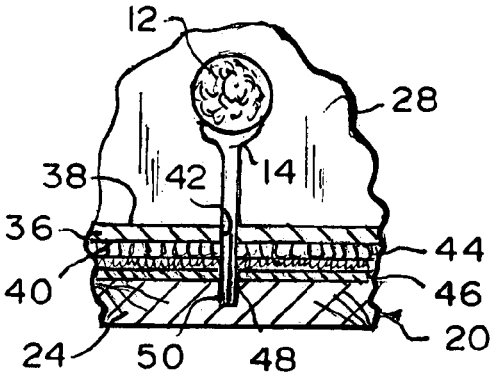
FIG. 4 is an enlarged diagrammatic cross sectional view taken along line 4—4 in FIG. 2.

As shown in FIG. 4, the through bore 42 in each insert of the at least one insert 36 of the golf course-related elements 18 is receivable of a tee 14 holdable of a golf ball 12 so as to replicate a tee in the hole of a green of a standard golf course holding a golf ball.

The tee 14 has a split shaft 48 to provide a snugger compressive fit in the through bore 42 in an insert of the at least one insert 36 of the golf course-related elements 18 which it is received in a mating socket 50 in the bottom wall 24 of the bottom portion 20 of the display case 16.

It will be understood that each of the elements described above, or two or more together, may also find a useful application in other types of constructions differing from the types described above.

While the invention has been illustrated and described as embodied in a case indicative of greens of a specific golf course for displaying golf balls on tees, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A case indicative of specific greens of a specific golf course for displaying golf balls on tees, said case comprising:

a) a display case; and b) golf course-related elements;

wherein said golf course-related elements are disposed in said display case, wherein said display case has a bottom portion;

wherein said display case has a top portion; and wherein said top portion of said display case selectively closes said bottom portion of said display case, wherein said bottom portion of said display case has a bottom wall;

wherein said bottom portion of said display case has a pair of side walls; and wherein said bottom portion of said display case has a rear wall, wherein said golf course-related elements comprise at least one insert; and wherein each insert of said at least one insert of said golf course-related elements replicates a specific green of a specific golf course.

2. The case as defined in claim 1, wherein said display case is generally rectangular-parallelepiped-shaped.

3. The case as defined in claim 1, wherein said top portion of said display case has a top wall; and wherein said top portion of said display case has a front wall.

4. The case as defined in claim 3, wherein said top wall of said top portion of said display case is transparent so as to allow seeing said golf-course related elements in said display case from their tops when said top portion of said display case is closed.

5. The case as defined in claim 3, wherein said front wall of said top portion of said display case is transparent so as to allow seeing said golf-course related elements in said display case from their sides when said top portion of said display case is closed.

6. The case as defined in claim 3, wherein said top wall of said top portion of said display case is hingedly attached, by hinges, to said rear wall of said bottom portion of said display case.

7. The case as defined in claim 3, wherein said front wall of said top portion of said display case depends from said top wall of said top portion of said display case; and wherein said front wall of said top portion of said display case overlies said front wall of said bottom portion of said display case when said top portion of said display case is closed.

8. The case as defined in claim 1, wherein said golf course-related elements sit on said bottom wall of said bottom portion of said display case.

9. The case as defined in claim 1, wherein said at least one insert of said golf course-related elements is eighteen to replicate the eighteen holes of a standard golf course.

10. The case as defined in claim 1, wherein each insert of said at least one insert of said golf course-related elements is generally flat; and wherein each insert of said at least one insert of said golf course-related elements is generally square-shaped.

11. The case as defined in claim 1, wherein each insert of said at least one insert of said golf course-related elements has a top surface; and wherein each insert of said at least one insert of said golf course-related elements has a bottom surface.

12. The case as defined in claim 11, wherein said top surface of each insert of said at least one insert of said golf course-related elements has indicia thereon; and wherein said indicia on said top surface of each insert of said at least one insert of said golf course-related elements pictorially replicates a specific green of a specific golf course.

13. The case as defined in claim 1, wherein each insert of said at least one insert of said golf course-related elements has a through bore;

wherein said through bore extends centrally through an associated insert of said at least one insert of said golf course-related elements; and wherein said through bore through an associated insert of said at least one insert of said golf course-related elements replicates the hole in a specific green of a specific golf course.

14. The case as defined in claim 11, wherein said bottom surface of each insert of said at least one insert of said golf course-related elements has a portion of hook and loop fasteners thereon; and wherein said portion of hook and loop fasteners on said bottom surface of each insert of said at least one insert of said golf course-related elements selectively mates with a sheet of a mating portion of hook and loop fasteners that covers said bottom wall of said bottom portion of said display case so as to allow each insert of said at least one insert of said golf course-related elements to be interchanged to replicate a specific green of a specific golf course.

15. The case as defined in claim 13, wherein said through bore in each insert of said at least one insert of said golf course-related elements is receivable of a tee holdable of a golf ball so as to replicate a tee in the hole of a green of a standard golf course holding a golf ball.

16. The case as defined in claim 15, wherein said tee is split to provide a snugger compressive fit in said through bore in an insert of said at least one insert of said golf course-related elements which it is received in.

* * * * *